US006283658B1

(12) United States Patent
Estevez et al.

(10) Patent No.: US 6,283,658 B1
(45) Date of Patent: Sep. 4, 2001

(54) CHAPSTICK DISPENSING APPARATUS

(75) Inventors: Carlos Irwin Estevez, Los Angeles; Rodger D. Thomason, Santa Monica, both of CA (US)

(73) Assignee: Masheen, Inc., Los Angeles, CA (US)

( * ) Notice: Subject to any disclaimer, the term of this patent is extended or adjusted under 35 U.S.C. 154(b) by 0 days.

(21) Appl. No.: 09/345,875

(22) Filed: Jun. 30, 1999

(51) Int. Cl.[7] ..... B43K 23/00
(52) U.S. Cl. ..... 401/98; 401/192; 401/68
(58) Field of Search ..... 401/60, 98, 68, 401/55, 59, 75, 122, 6; 16/430; D28/85, 4

(56) References Cited

U.S. PATENT DOCUMENTS

| | | | | |
|---|---|---|---|---|
| D. 180,022 | | 4/1957 | Kent . | |
| 1,218,186 | | 3/1917 | Kennedy . | |
| 1,890,295 | | 12/1932 | Jacobs . | |
| 1,943,048 | | 1/1934 | Wallace . | |
| 2,203,494 | | 6/1940 | Greenhill . | |
| 2,776,051 | | 1/1957 | Warren, Jr. . | |
| 3,185,345 | | 5/1965 | Hunegs . | |
| 3,941,489 | * | 3/1976 | Bryan | 401/59 |
| 4,208,144 | | 6/1980 | Idec et al. | 401/192 |
| 5,156,311 | | 10/1992 | Spencer, Jr. et al. | 225/41 |
| 5,352,053 | * | 10/1994 | Reitze | 401/98 |
| 5,358,349 | * | 10/1994 | Burroughs et al. | 401/6 |
| 5,431,177 | | 7/1995 | Kecman | 132/303 |
| 5,538,161 | | 7/1996 | Koehler et al. | 222/46 |
| 5,676,480 | * | 10/1997 | Tosto | 401/192 |
| 5,833,962 | * | 11/1998 | Chen | 401/59 |
| 5,984,551 | * | 11/1999 | Kinney, Jr. | 401/60 |

FOREIGN PATENT DOCUMENTS

| | | | | |
|---|---|---|---|---|
| 2278578 | * | 5/1993 | (GB) | 401/6 |

* cited by examiner

*Primary Examiner*—David J. Walczak
(74) *Attorney, Agent, or Firm*—Cisha & Thomas LLP

(57) ABSTRACT

The chapstick dispensing apparatus provides convenient use and asymmetrical, tactile geometry, aiding manual determination of the disposition of the device. The cap for the chapstick dispensing apparatus is slidably, pivotably, or hingeably attached to a housing so that no separate cap is present with its accompanying risk of loss or of being dropped. The housing is generally asymmetrical and may have an asymmetrical series of tactile protrusions to help determine the disposition or attitude of the chapstick dispensing apparatus, even though manual dexterity is limited as by gloves or mittens. A cover having a cap and finger cradle may slidably engage the housing to open or close the dispensing apparatus. The lip balm product is disposed within the housing and may be ejected or retracted by an ejector such as a threaded rod and turnwheel or an elevator controlling a platform. The housing may form a channel for the lips to facilitate application of the lip balm product. The cover may pivotably or hingeably attach to the housing and form a snap-fit in conjunction with the housing and/or oppositely opposed finger grips present on the housing. A lanyard ring may also provide additional utility by allowing the chapstick dispensing apparatus to be hung around a person's neck or wrist.

11 Claims, 7 Drawing Sheets

CHAPSTICK DISPENSING APPARATUS

BACKGROUND OF THE INVENTION

1. Field of the Invention

This invention relates to lip balm holders and more particularly to a chapstick dispensing apparatus having an attached cover that is not easily lost as it is not dissociated from the main portion of the dispenser.

2. Description of the Related Art

Lip balms are often used to soothe and heal lips that may become dry or chapped under a variety of circumstances including those encountered in athletic, outdoor activities, such as skiing, sailing, and other environments where dry air comes in constant contact (such as by a breeze or wind) with the lips. Lip balms often comprise a paraffin-like substance which adheres to the lips when drawn over them. Additional emollients or moisturizing additives may even be included in the lip balm, as may UV protective chemicals and the like. By providing a polar or hydrophobic barrier to the elements, moisture is retained in the lips. Additionally, lip balms protect the lips from such harsh environments.

Currently, lip balm dispensers often include a threaded rod or screw that serves to turnably eject the stick of lip balm. The lip balm may have a central channel or circular cavity into which the threaded rod fits and in which the threaded rod turns. As the threaded rod turns, as by a thumbscrew or wheel, the lip balm is selectively ejected from the dispenser.

A cap is generally used to cover the end of the dispenser in order to prevent the drying out of the lip balm. The cap often is spaced away from the end of the dispenser so that a margin of lip balm may be exposed for easy application to the lips. However, the cap is often lost as it is easily disassociated from the dispenser.

Additionally, the dispenser as a whole with its cap may be difficult to manipulate, particularly under inclement conditions such as ski slopes or the like where the hands of the user are often encumbered by gloves or mittens. The disassociatable cap to the lip balm dispenser requires two (2) hands to use or very dexterous one (1) hand. Such one-handed use is often precluded by the presence of mittens or gloves.

Additionally, present lip balm dispensers often have no lanyard ring or tactile side indicators regarding orientation of the dispenser. Furthermore, hand or fingerholds are generally absent from such lip balm dispensers. Aesthetic designs are often absent, preventing the lip balm dispenser from acting as an attractive or fashionable accessory to a person's outfit or clothing.

It would be an advance of the art to overcome these shortcomings and to resolve these disadvantages in a manner that is both useful and attractive, making the use and carrying of a lip balm dispenser easier and more fun.

SUMMARY OF THE INVENTION

The present invention provides a lip balm dispenser having an associated cap that remains with the dispenser even though the lip balm product is exposed. Additionally, a translucent or transparent lens or window provides indication of the amount of lip balm product left and the operation of the generally slow ejection of the lip balm product.

A turnscrew or wheel serves to slowly eject the lip balm product. The cover may slidably move along a track provided by a housing in order to expose the lip balm product or application.

In alternative embodiments, principal features of convenience in one-handed use are present, as is the cap-retaining feature. Elevators or the like can be used to expose the lip balm product. Additionally, grips or other tactile features may be present in order to provide better handling for the dispenser. In one embodiment, the cover may hingeably pivot such that the housing and the lip balm product are exposed in the same manner as a switchblade knife. Additionally, lanyard rings or the like can be used to provide attachment for cords or string, making the chapstick dispensing apparatus of the present invention more easily available.

OBJECTS OF THE INVENTION

It is an object of the present invention to provide a self-contained chapstick or lip balm dispenser.

It is an additional object of the present invention to provide a lip balm dispenser that retains its cap.

It is an additional object of the present invention to provide a chapstick dispenser that is easier to use when the hands are made less dexterous by means of gloves or mittens.

It is an additional object of the present invention to provide a chapstick dispenser that indicates the amount of lip balm product remaining.

It is yet another object of the present invention to provide a chapstick dispenser that is fashionable and attractive.

It is yet another object of the present invention to provide a chapstick dispenser that is easily manufactured and simple to use.

These and other objects of and advantages of the present invention will be apparent from a review of the following specification and accompanying drawings.

DESCRIPTION OF THE PREFERRED EMBODIMENT(S)

The detailed description set forth below in connection with the appended drawings is intended as a description of presently preferred embodiments of the invention and is not intended to represent the only forms in which the present invention may be constructed and/or utilized. The description sets forth the functions and the sequence of steps for constructing and operating the invention in connection with the illustrated embodiments. However, it is to be understood that the same or equivalent functions and sequences may be accomplished by different embodiments that are also intended to be encompassed within the spirit and scope of the invention.

The present invention provides means by which lip balm, chapstick, or the like may be easily applied to the lips in a secure and convenient fashion. The present invention provides a dispenser that is easily manipulated which provides protection for the lip balm product, and which allows inspection of the remaining lip balm product available.

Figure 1:
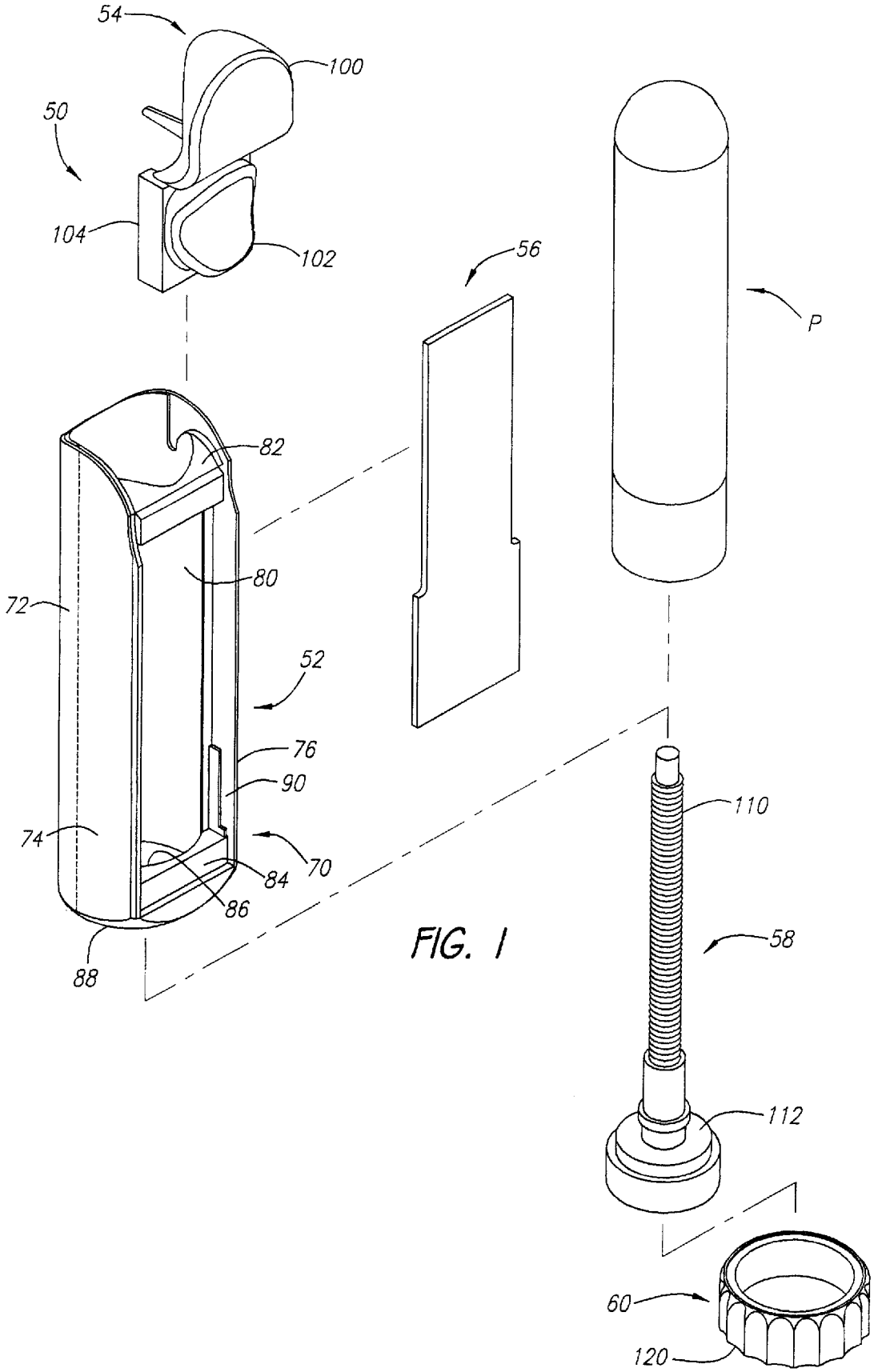
FIG. 1 is an exploded perspective view of one embodiment of the chapstick dispensing apparatus of the present invention.
Figure 4:
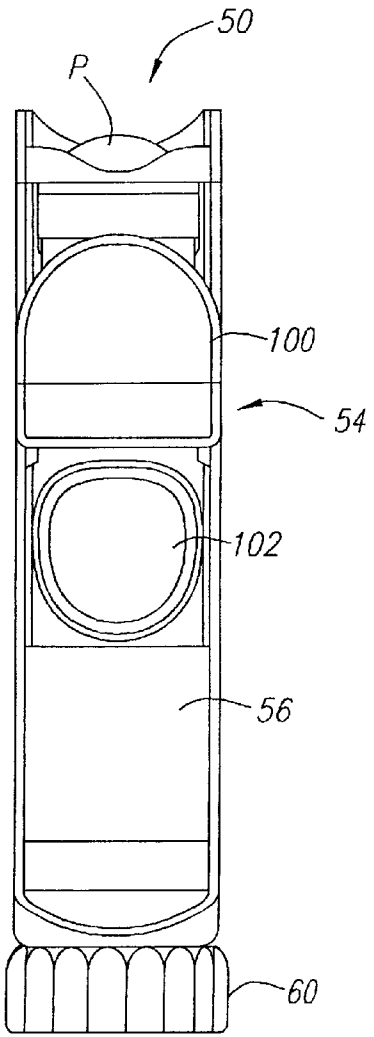
FIG. 4 is a front elevational view of the chapstick dispensing apparatus of FIG. 1.
Figure 3:
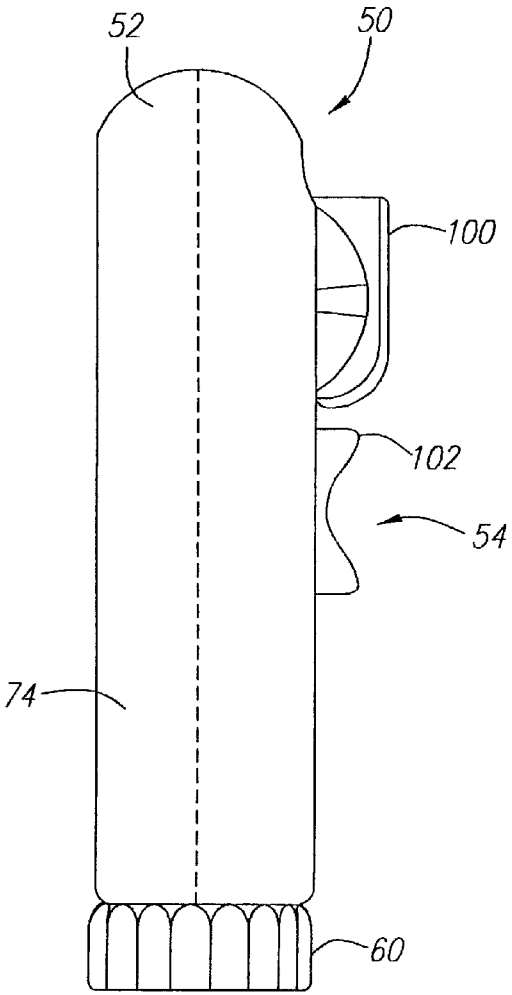
FIG. 3 is a right side elevational view of the chapstick dispensing apparatus of FIG. 1.
Figure 2:
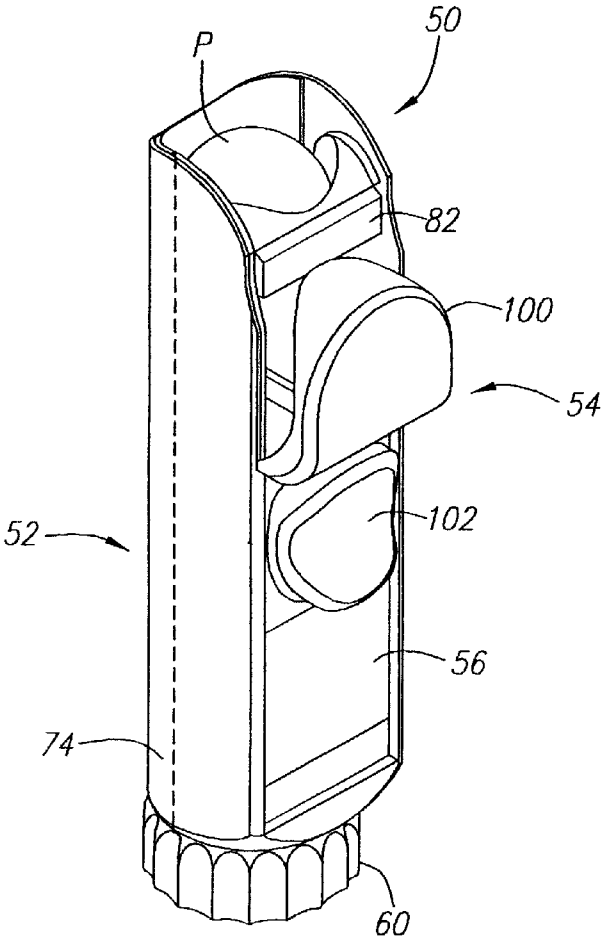
FIG. 2 is a right side perspective view of the chapstick dispensing apparatus of FIG. 1.
Figure 7:
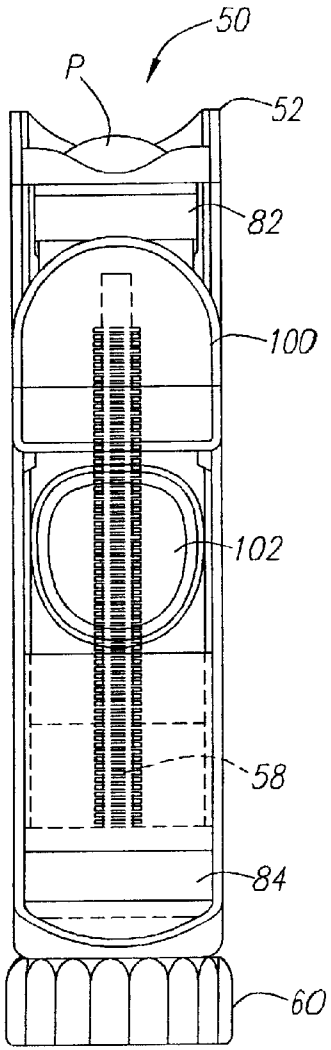
FIG. 7 is a front elevational and partial cutaway view of the chapstick dispensing apparatus of FIGS. 1 and 4, with some features shown in phantom.
Figure 6:
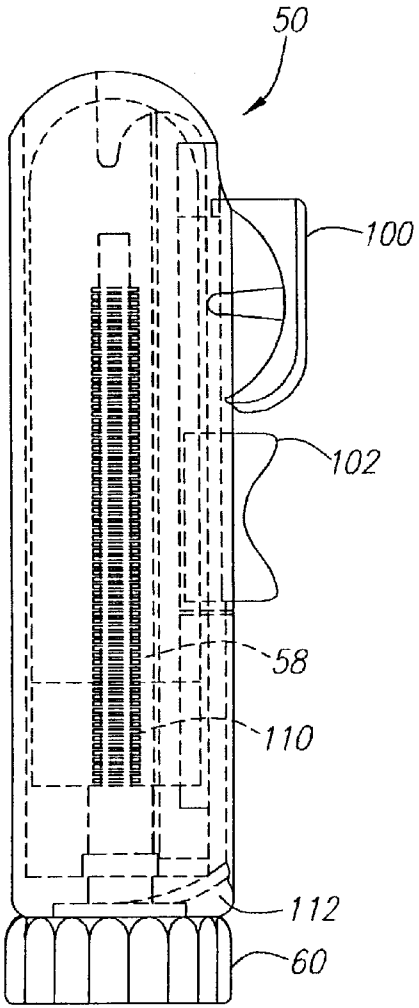
FIG. 6 is a right side elevational and partial cutaway view of the chapstick dispensing apparatus of FIGS. 1 and 3, with some features shown in phantom.
Figure 5:
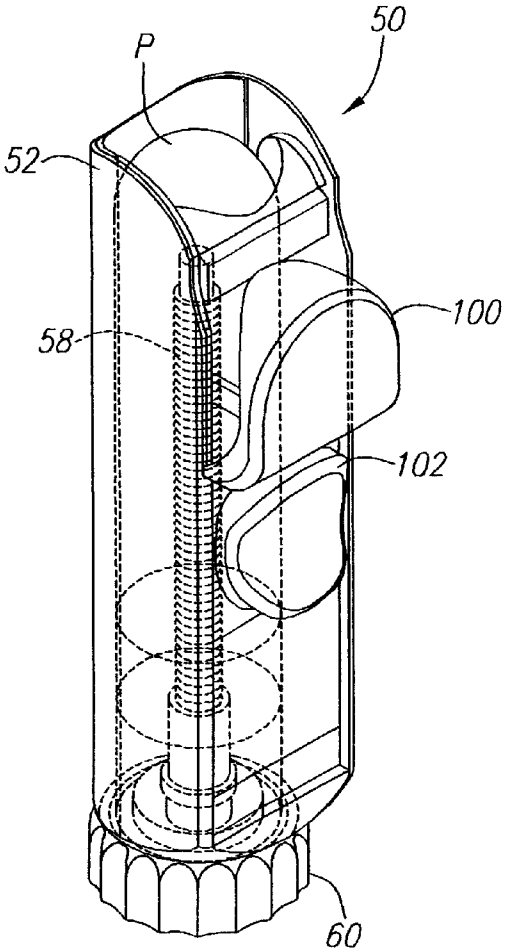
FIG. 5 is a right perspective and partial cutaway view of the chapstick dispensing apparatus of FIGS. 1 and 2, with some features shown in phantom.

As shown in FIG. 1, the chapstick dispensing apparatus 50 of the present invention has a housing 52, a cover 54, a translucent or transparent lens 56, a threaded rod 58, and a turnscrew or wheel 60. Also shown in FIG. 1 is the elongated bullet shape of the chapstick lip balm or other similar product P.

As shown in the Figures, the housing 52 may be asymmetrical in shape. The front 70 and rear 72 of the housing 52 are generally flat or straight in nature. The right side 74 and left side 76 of the housing 52 are generally curved in nature. The asymmetrical and geometrical differences between the differing sides of the housing 52 make it easier to determine its disposition when held in even a gloved or mittened hand.

The front 70 of housing 52 is generally open in nature, exposing the interior 80 of the housing 52. Upper 82 and lower 84 spanning supports serve to spatially separate the right 74 and left 76 sides of the housing 52. An aperture 86 through which the threaded rod 58 may travel in order to engage the lip balm product P is present at the bottom 88 of the housing 52.

In order to engage the cover 54, and as set forth in more detail below, the forward interior portions of the right and left side 74, 76 of the housing 52 have a pair of parallel grooves 90, spaced apart and sized so that the cover 54 may travel along the grooves 90.

The right and left sides 74, 76 of the housing 52 may either be curved or beveled.

The cover 54 has two (2) distinct portions: an articulating top cap 100 and a finger-engaging cradle 102. The top cap 100 is hingeably or pivotably attached to the cradle 102, as by a living hinge. In one embodiment, the cap 100 is biased such that it closes towards the rear or back side of the cradle 102. In this way, the cap 100 serves to keep the lip balm product P in the enclosed environment of the housing interior 80 when the cover 54 is closed. Alternatively, the cap 100 may have fingers or struts that travel along the grooves 90 of the housing 52. The grooves 90 curve about adjacent the top of the housing 52 so as to force the cap 100 to close over and to seal in the lip balm product P within the housing 52.

The finger-engaging cradle 102 has a foundation base or support 104 that engages the housing 52 and allows the cradle 102 to travel along the grooves 90 therein. The cradle 102 generally travels along the vertical lateral front section of the housing 52 and when the cradle 102 is in the topmost-up position (FIG. 8), the cap 100 encloses the housing interior 80 and the lip balm product P contained therein.

Also enclosing the front 70 of the housing 52 is a lens, plate or window 56 that is generally flat in nature to conform to the geometry of the housing 52. The lens 56 may be transparent or translucent so that light may travel through it and so that a user may visually inspect the lip balm product P as it is disposed upon the threaded rod 58. As the lip balm product P may be refilled from time to time after it has been used up, the lens 56 allows visual inspection of the amount of lip balm product P remaining. The lens 56 also allows inspection of the confines of the housing interior 80 so that if dirt or water have lodged themselves inside the housing 52, visual inspection will reveal this and appropriate action may be taken. The lens 56 may snap fit or otherwise be permanently or semi-permanently connected to the housing 52. The lens 56 generally lies underneath the cover 54 as it travels along the front 70 of the housing 52. The lens 56 is framed by the upper and lower spanning supports and the right and left sides of the housing. The lens 56 does not obstruct the travel of the cover 54.

In order to control the exposure or ejection of the lip balm product P from the chapstick dispensing apparatus 50 of the present invention, a threaded rod 58 is used as an ejector to threadably engage a central interior channel of the lip balm product P. The threads 110 of the threaded rod 58 are disposed at an angle or inclination such that turns of an associated turnscrew or wheel 60 serve to slowly eject or retract the lip balm product P from the end of the threaded rod 58. In order to ensure that the lip balm product P does not turn with the threaded rod 58, the lip balm product P generally enjoys a snug, but gentle, fit with respect to the interior of the housing 52. As the lip balm product P is generally constructed of paraffin or other non-toxic and hypoallergenic hydrocarbon, the often-waxy nature of the lip balm product P serves as means by which it self-lubricates its travel laterally through the housing 52 while inhibiting turning with the threaded rod 58.

The threaded rod 58 may have a base 112 that allows the threaded rod 58 to snap-fit within the area adjacent of the bottom aperture 86 of the housing 52. An associated turnscrew, thumbscrew, turn wheel, or the like 60 may be attached to the base 112 of the threaded rod 58. The turnscrew 60 may have a number of ridges or indentations 120 that serve as means by which the turning motion of the threaded rod 58 may be better controlled and to allow a secure and easy grip.

FIGS. 1–10 show the chapstick dispensing apparatus 50 of the present invention as described above. Other alternative embodiments are also disclosed below. Similar elements have similar reference numbers while additional features may be numbered separately. Some features that are present in all the embodiments include the asymmetrical and tactile configuration of the dispenser 50.

Figure 10:
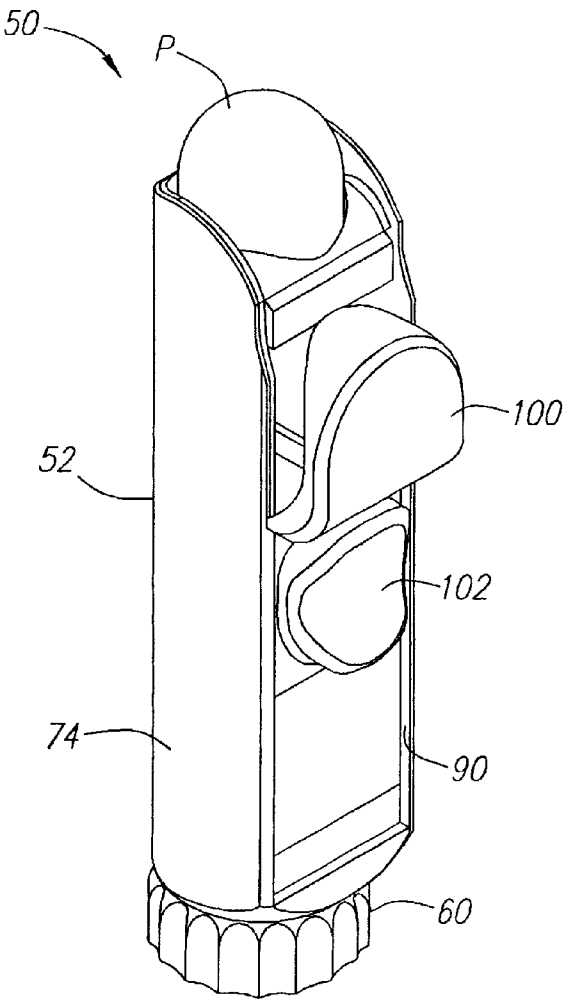
FIG. 10 is a right side perspective view of the chapstick dispensing apparatus of FIG. 1 with the cover retracted and the lip balm product exposed for application.
Figure 9:
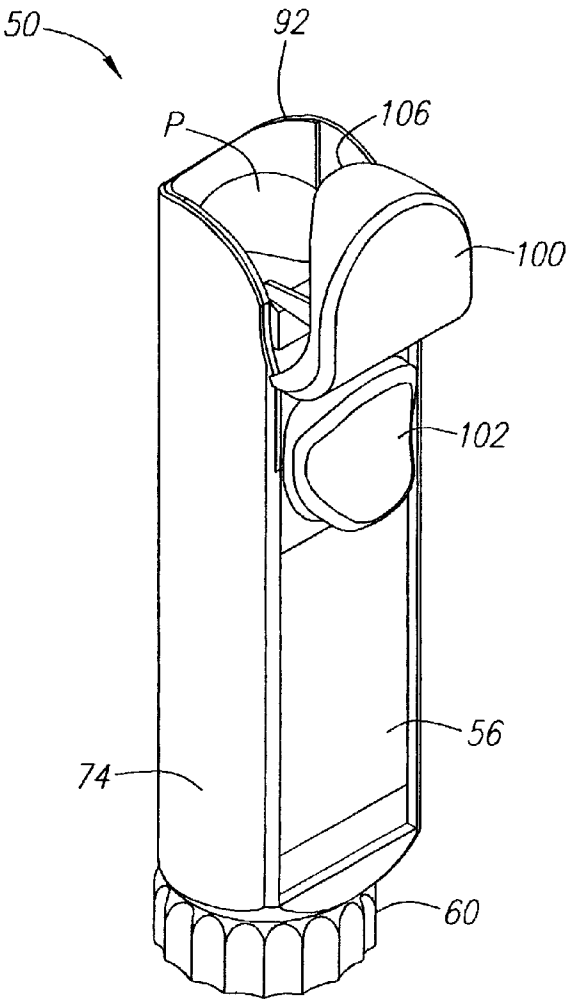
FIG. 9 is a right side perspective view of the chapstick dispensing apparatus of FIG. 1, showing the articulation of the cover as it is retracted to uncover the lip balm product.
Figure 8:
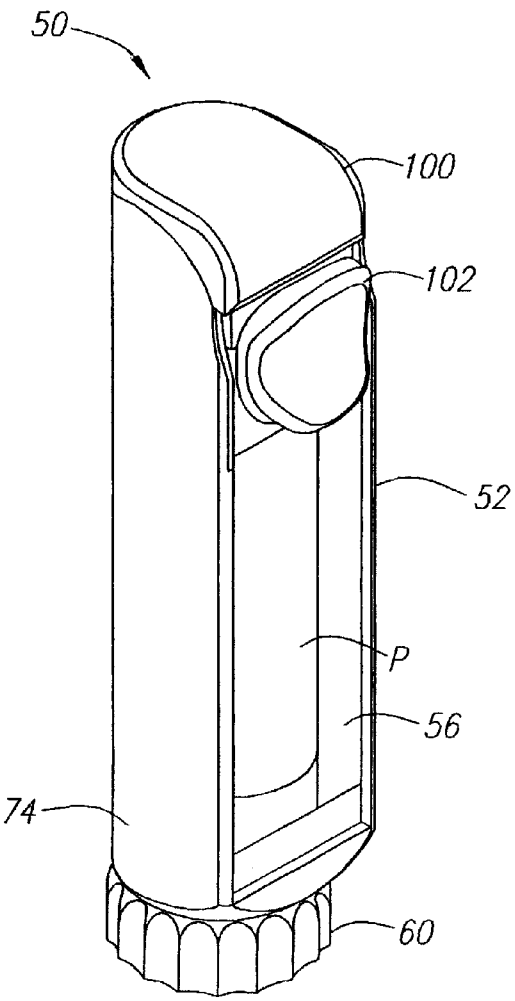
FIG. 8 is a right side perspective view of the chapstick dispensing apparatus of FIG. 1.

As shown in FIGS. 8–10, the cover 54 fits over the top of the housing 52 in order to seal in the lip balm product P. The right and left side 74, 76 of the housing 52 may be positively or convexedly curved at the top 92 of the housing 52. The convexedly-curved shape of the top 92 of the housing 52 allows it to sealingly contact the edge of the cap 100 to close the dispenser 50. The cap 100 may have an edge 106 that matches the curvature and shape of the top 92 of the housing 52. As shown in FIG. 9, the convexedly-curved top portions of the right and left sides 74, 76 of the housing 52 are mediated at the edge by a concavedly-curved portion. A correspondingly convex portion of the cap 100 serves to contactingly abut the entire edge of the top 92 of the housing 52. In this manner, the top 92 of the housing 52 may be closed by the cap 100 when the finger-engaging cradle 102 is moved to its topmost position along the front 70 of the housing 52.

The convex tops of the right and left sides 74, 76 of the housing 52 in conjunction of the concavedly-curved top of the rear 72 of the housing 52 serve to provide a channel that may be used to guide the lips over the lip balm product P and vice versa. The use of the dispenser 50 is then made easier as not only the manual engagement of the dispenser 50 is determined in a tactile manner, but also the application of the lip balm product P to the lips is improved as the right and left sides 74, 76 of the housing 52 serve to guide the to dispenser 50 and the lip balm product P over the lips.

As can be seen by comparing FIG. 8 with FIG. 9, the cap 100 extends above the top 92 of the housing 52. This extension of the cap 100 allows the lip balm product P to be projected up from the housing 52 before it comes into contact with the underside of the cap 100 or closely adjacent thereto. When the lip balm product P is so disposed beneath the closed cap 100, opening the cover 54 by engaging the finger-engaging cradle 102 and sliding it downwards along the front face 70 of the housing 52 serves to expose the topmost portion of the lip balm product P. As the lip balm product P has been upwardly extended by turning the thumb wheel 60 or the like, it is immediately ready for application to the lips in order to relieve or prevent chapping. When one's manual dexterity is limited due to the presence of gloves or mittens, the large and easily turned thumb wheel 60 in conjunction with the finger cradle 102 serve to provide easy means by which the chapstick dispensing apparatus 50 of the present invention may be put to use in rapid and convenient fashion.

The chapstick dispensing apparatus 50 of the present invention may be made of lightweight and waterproof or water-resilient material, such as plastic. Additionally, with plastic or other synthetic materials, bright and attractive colors may be added to the plastic prior to molding the parts, such that a vibrant, subdued or otherwise attractive chapstick dispensing apparatus may be formed. For some customers or consumers, bright dayglow or other optically active colors might be used in attractive color combinations so as to make the chapstick dispensing apparatus 50 of the present invention a more commercially viable product.

Having set forth the basic elements of the chapstick dispensing apparatus 50 of the present invention, alternative embodiments are shown in FIGS. 11–18.

Figure 13:
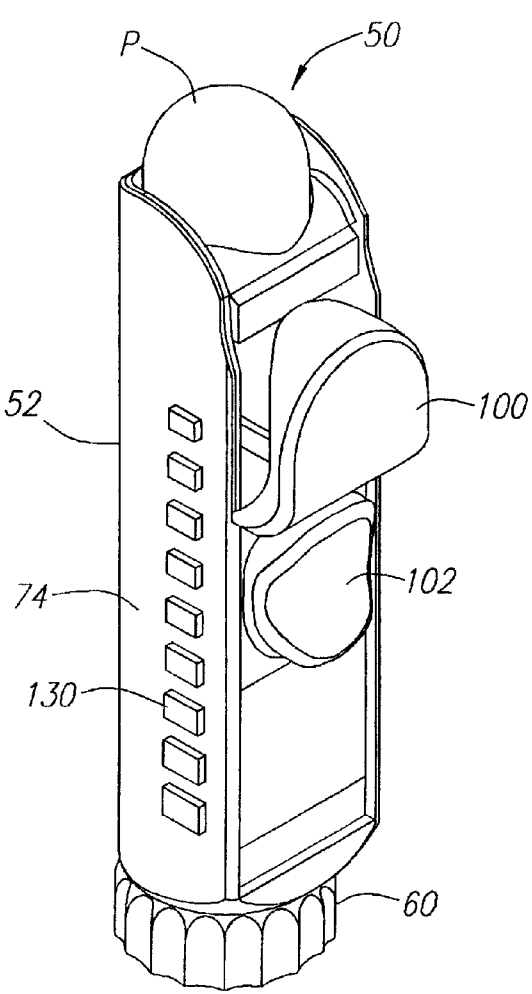
FIG. 13 is a right side perspective view of the chapstick dispensing apparatus of FIG. 11, with the cover fully retracted and the lip balm product partially exposed.
Figure 12:
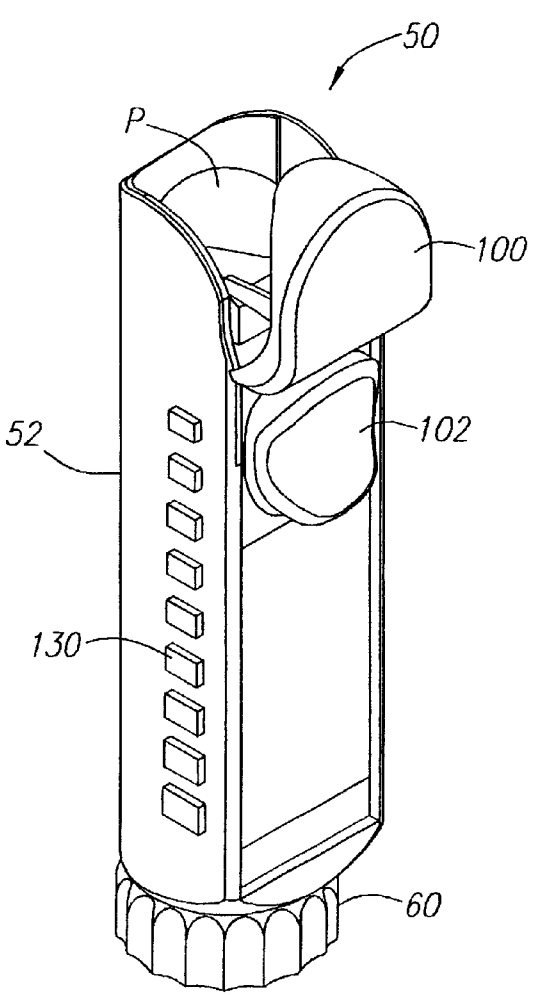
FIG. 12 is a right side perspective view of the chapstick dispensing apparatus of FIG. 11, with the cover partially retracted.
Figure 11:
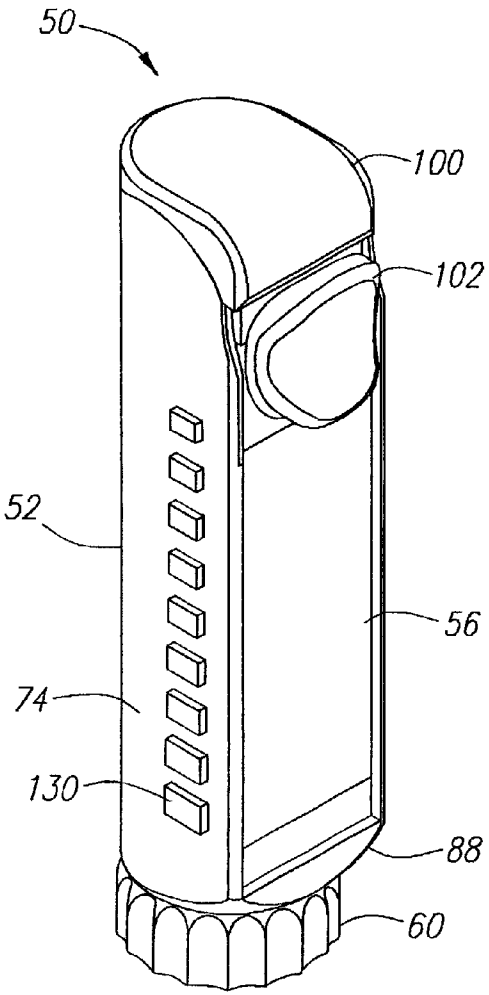
FIG. 11 is a right side perspective view of an alternative embodiment of the chapstick dispensing apparatus of FIG. 1, shown in a closed position.

Particularly, FIGS. 11–13 show an alternative embodiment of the present invention, where the chapstick dispensing apparatus 50 has certain tactile stubs or protrusions 130 along one or both sides of the housing 52. The tactile protrusions 130 act as indicators of the vertical disposition of the chapstick dispensing apparatus 50 of the present invention. As shown in FIG. 11, the tactile protrusions 130 are generally parallel to the front face 70 of the housing 52 and increase in height as travel is made towards the base or bottom 88 of the housing 52. Additionally, the width of the tactile protrusions 130 may increase as travel is made towards the housing base 88. When grasped between the thumb and forefinger or the like, the individual can tell relatively quickly which direction the lip balm product P is oriented as the smoother or less protruded end of the housing 52 is that which is most adjacent to the cover 54 and the lip balm product P. Other such tactile protrusions 130 may be used in conjunction with the present invention. Asymmetry present in such tactile protrusions may also serve to indicate orientation of the chapstick dispensing apparatus 50 of the present invention.

Figure 16:
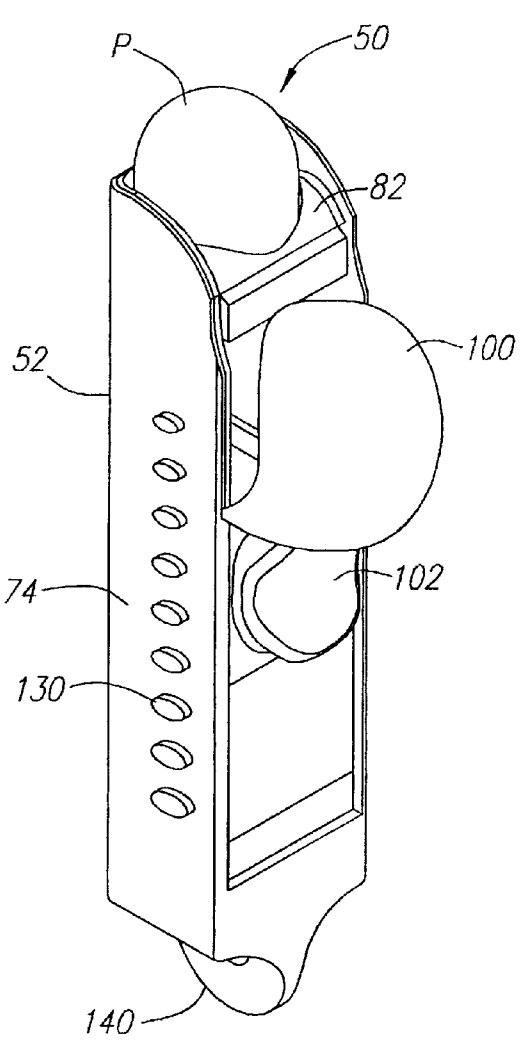
FIG. 16 is a right side perspective view of the chapstick dispensing apparatus of FIG. 14 with the cover fully retracted and the lip balm product partially exposed for application.
Figure 15:
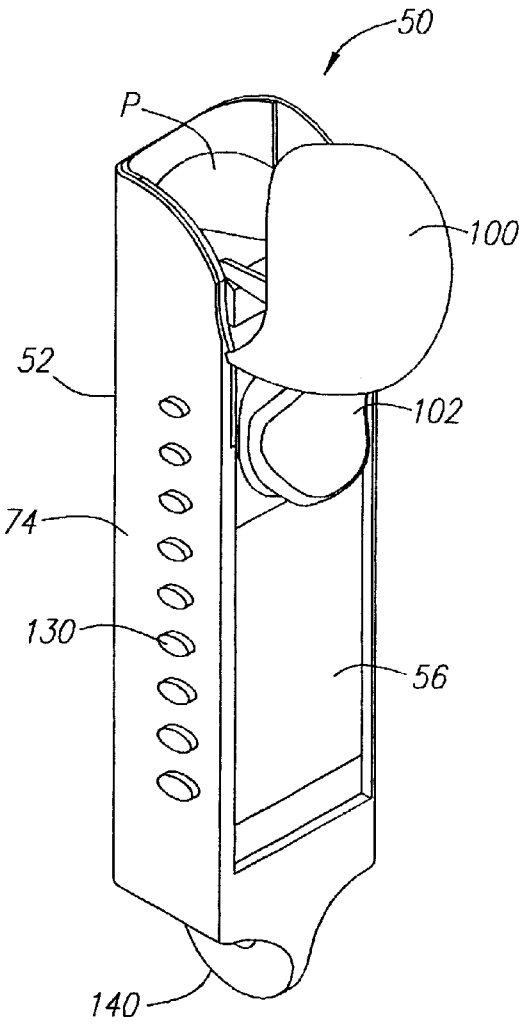
FIG. 15 is a right side perspective view of the chapstick dispensing apparatus of FIG. 14 with the cover partially retracted.
Figure 14:
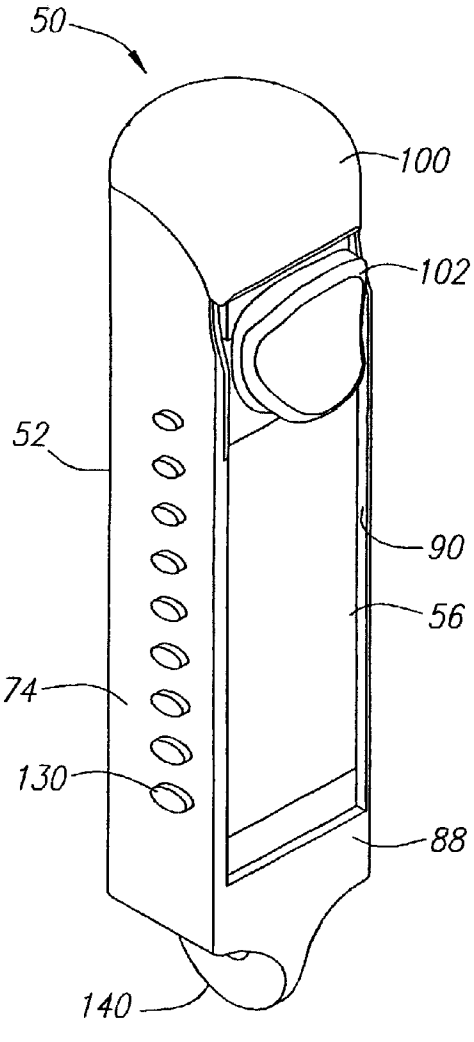
FIG. 14 is a right side perspective view of an alternative embodiment of the chapstick dispensing apparatus of FIG. 1.

As shown in FIGS. 14–16, a third alternative embodiment of the chapstick dispensing apparatus 50 of the present invention is shown. As seen in FIG. 14, the tactile protrusions 130 have taken the form of ovals, rather than the squares/rectangles shown in FIGS. 11–13. Additionally, the cap 100 stands taller and encompasses more volume than the cap shown in the prior Figures. The greater height of the cap 100 serves to allow greater protrusion of the lip balm product P from the interior 80 of housing 52.

In FIG. 14, as well as FIGS. 15 and 16, a lanyard ring 140 is shown at the base 88 of the chapstick dispensing apparatus 50 of the present invention. The lanyard ring 140 takes the place of the thumb wheel 60. In the place of the threaded rod 58 and the wheel 60, an ejector in the form of an elevator-like device 158 may control the attitude of the lip balm product P within the housing 52. An extension or post from a slidable platform (both not shown) may provide means by which the lip balm product P may be attitudinally disposed within the confines of the housing 52.

Figure 18:
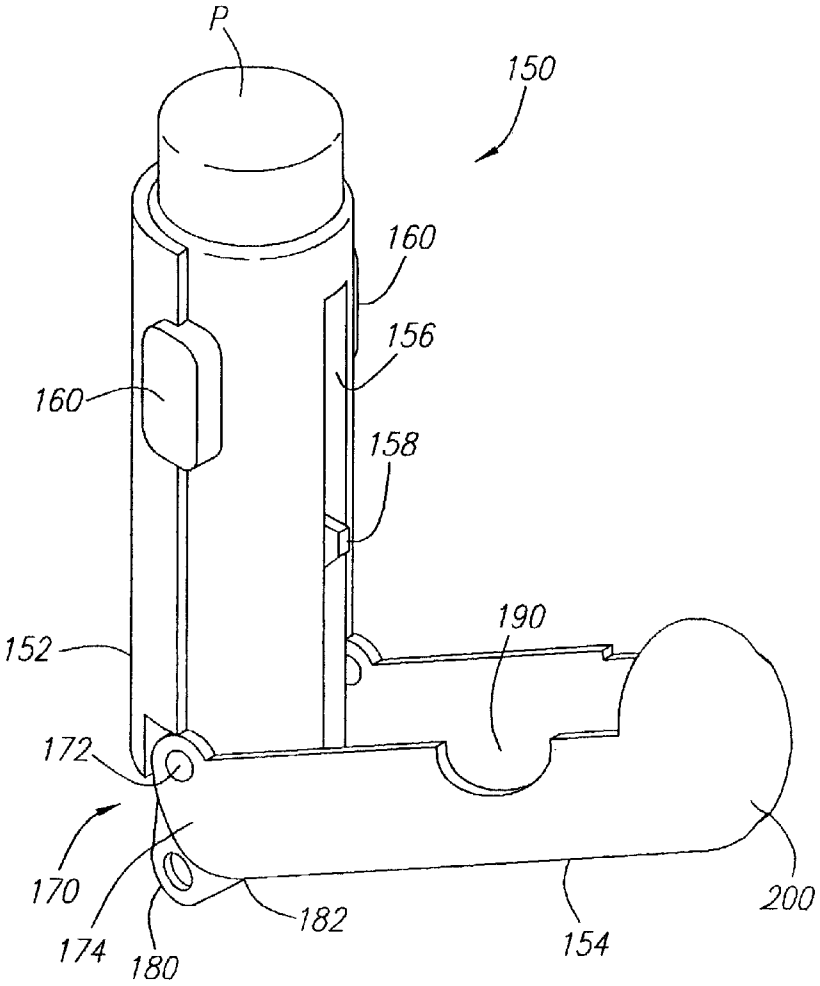
FIG. 18 is a right side perspective view of the chapstick dispensing apparatus of FIG. 17 with the lip balm product partially exposed.
Figure 17:
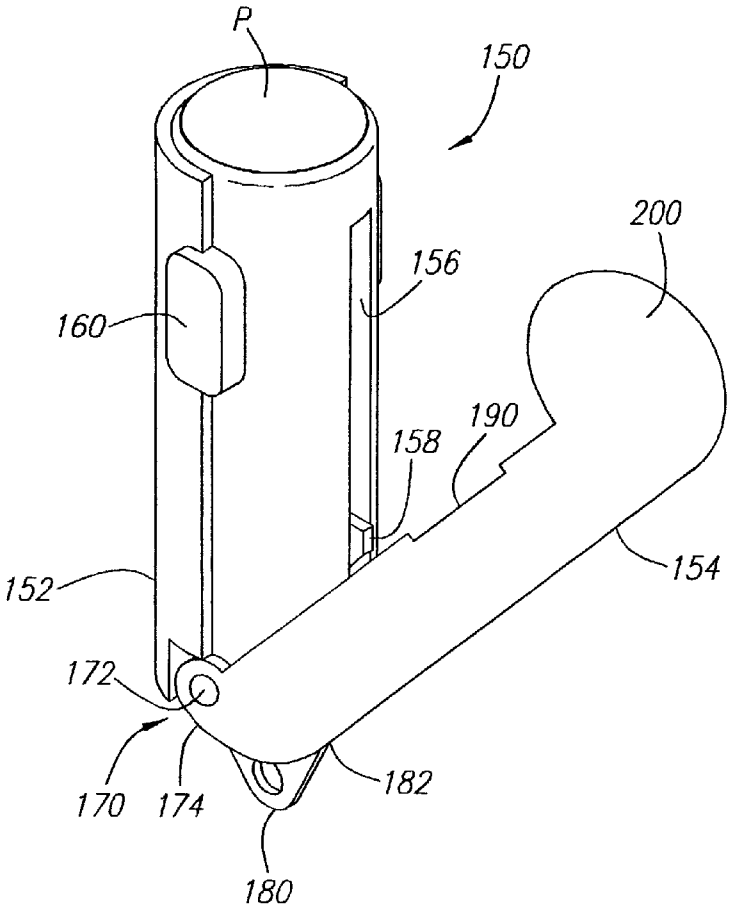
FIG. 17 is a right side perspective view of an alternative embodiment of the chapstick dispensing apparatus of FIG. 1.

FIGS. 17 and 18 show an additional embodiment of the present invention. As shown in FIG. 17, the chapstick dispensing apparatus 150 has a folding configuration with a housing 152 fitting partially within and being covered by a cover 154. The housing 152 is generally cylindrical in shape, conforming to the lip balm product P. A significantly smaller aperture 156 in the side of the housing 152 and generally traveling along a predominant portion of its length is present that may act similarly to the lens 56 of the prior embodiments. Slidably traveling through the aperture 156 is an elevator or the like 158 that serves to expel or retract the lip balm product P from the interior confines of the housing 152. The elevator 158 may be connected to a slidable platform or the like (not shown) held within the confines of the housing 152, and to which the lip balm product P may be attached.

The housing 152 may have one (1) or more finger grips or rests 160 which both provide means by which the chapstick dispensing apparatus 150 of FIG. 17 may be better held, and by which the operation end of the chapstick dispensing apparatus 150 and the housing 152 may be determined.

The cover 154 is pivotally attached to the housing 152 by means of a hinge, pivot, or the like 170. The hinge 170 may be formed by pins or posts 172 protruding from the housing 152 and fitting into a hole or other aperture 174 present in the cover 154. The posts 172 and apertures 174 may be symmetrically disposed about the chapstick dispensing apparatus 150 so as to form the hinge 170.

The housing 152 may also provide a lanyard ring 180. The lanyard ring 180 may project through the cover 154 and so must be accommodated by a slot 182 present in the cover 154 to accommodate the lanyard ring 180. The cover 154 may extend the length of the housing 152 and be generally semi-cylindrical in nature. The cover 154 may have indentations 190 to accommodate the finger grips 160 present on opposite sides of the housing 152. The top of the cover 154 may terminate in a cap 200 that serves to fit over and seal the open end of the housing 152 to thereby protect the lip balm product P. The cap 200 may provide a snap fit seal over the open end of the housing 152 in order to better protect and seal the lip balm product P inside the housing 152.

In use, the chapstick dispensing apparatus 150 of FIGS. 17 and 18 may generally be held in a pocket at the end of a lanyard in its closed condition where the cover 154, with its cap 200, is held in snap-fit attachment to the housing 152. The chapstick dispensing apparatus 150 then generally forms a cylinder having extending finger grip protrusions 160 and the lanyard ring 180. When the lip balm product P is needed or desired, the cover 154 is pivoted upon the hinge 170 and the snap fit of the cap 200 over the open end of the housing 152 is released, thereby exposing the lip balm product P. The cover 154 may pivot away from the housing 152 in order to provide convenient extension means by which a hand may grasp the now-open chapstick dispensing apparatus 150 as a whole.

The elevator 158 may be adjusted so as to determine the projection or protrusion of the operational end of the lip balm product P from the open end of the housing 152. The lip balm product P may then be applied to the lips or other chapped skin in order to protect or heal it. If the lip balm product P is not extended too far away from the open end of the housing 152, such that it might interfere with the cover 154, the cover 154 may be pivoted upon the hinge 170 back into place with the cap 200 fitting or snapping over the open end of the housing 152.

Alternatively or additionally, some mechanical engagement to ensure closure of the cover 154 about the housing 152 may be accomplished between the finger grips 160 and the indentations 190. As for the other embodiments, the cap 200 may provide some measure of protrusion of the lip balm product P without interfering with the lip balm product P. In this way, the lip balm product P is available for ready use once the cover 154 is rotated upon the hinge 170 and the housing 152 and lip balm product P are exposed for use.

While the present invention has been described with regards to particular embodiments, it is recognized that additional variations of the present invention may be devised without departing from the inventive concept.

What is claimed is:

1. A chapstick dispensing apparatus for conveniently dispensing lip balm, comprising:

a housing, said housing providing an interior space for lip balm, said housing providing a base defining a bottom aperture, said bottom aperture communicating with said interior lip balm space;

said housing defining a lip channel for easier and more directed application of the lip balm to a lip;

a cover, said cover coupled to said housing and selectably exposing the lip balm while remaining attached to said housing;

an ejector for controllably ejecting the lip balm;

a lens, said lens adjacent said interior space for lip balm and making visible the lip balm;

an upper spanning support;

a lower spanning support;

said upper and lower spanning supports providing structural integrity about said lens; and right and left sides respectively defining first and second grooves, said first and second grooves oppositely opposed and parallel; whereby the chapstick dispenser prevents and relieves chapped lips in a convenient manner without risking loss of said cover.

2. The chapstick dispensing apparatus for conveniently dispensing lip balm as set forth in claim 1, wherein said housing further comprises:

a rear side panel, said rear side panel having a concavedly curved upper end adjacent the lip balm;

said right and left sides having convexedly curved upper ends adjacent the lip balm and said rear side panel upper end; whereby said lip channel is defined by said upper ends of said rear side panel and said right and left sides.

3. The chapstick dispensing apparatus for conveniently dispensing lip balm as set forth in claim 1, wherein said cover restrictedly travels along said first and second grooves.

4. The chapstick dispensing apparatus for conveniently dispensing lip balm as set forth in claim 3, wherein said cover further comprises:

a cap, said cap selectably covering and exposing the lip balm; and a finger cradle, said finger cradle coupled to said cap, said finger cradle providing an easily discernible and tactile control for said cap despite impaired manual dexterity such as when mittens or gloves are worn.

5. The chapstick dispensing apparatus for conveniently dispensing lip balm as set forth in claim 4, wherein said cover further comprises:

said cap hingeably attached to said finger cradle, said cap conforming to a top portion of said housing to close the chapstick dispensing apparatus.

6. A chapstick dispensing apparatus for conveniently dispensing lip balm, comprising:

a housing, said housing providing an interior space for lip balm, said housing providing a tactile protrusion, said tactile protrusion indicating in a tactile manner disposition and orientation of said housing, said tactile protrusion sufficiently pronounced to be manually detected through mittens or gloves;

said tactile protrusion providing a series of outward projections projecting outwardly from said housing, said outward projections more pronounced toward a base of said housing and less pronounced toward a top of said housing, said series of outward projections generally conforming to a finger gripping said housing;

a cover, said cover coupled to said housing and selectably exposing the lip balm while remaining attached to said housing; and an ejector for controllably ejecting the lip balm; whereby the chapstick dispenser prevents and relieves chapped lips in a convenient manner without risking loss of said cover.

7. The chapstick dispensing apparatus for conveniently dispensing lip balm as set forth in claim 6, wherein said series of outward projections have a shape selected from the group consisting of:

squares, rectangles, and ovals.

8. A chapstick dispensing apparatus for conveniently dispensing lip balm, comprising:

a housing, said housing providing an interior space for lip balm, said housing having a base defining a bottom aperture, said bottom aperture communicating with said interior lip balm space, said housing having an upper spanning support and a lower spanning support, said upper and lower spanning supports providing structural integrity, said housing having right and left sides respectively defining first and second grooves, said first and second grooves oppositely opposed and parallel, said housing having a rear side panel, said rear side panel having a concavedly curved upper end adjacent the lip balm, said right and left sides having convexedly curved upper ends adjacent the lip balm and said rear side panel upper end, said housing defining a lip channel for easier and more directed application of the lip balm to a lip, said lip channel defined by said upper ends of said rear side panel and said ride and left sides;

a cover, said cover coupled to said housing, said housing and said cover being easily manipulated and held despite impaired manual dexterity such as that when mittens or gloves are worn, said cover restrictedly traveling along said first and second grooves, said cover having a cap, said cap selectably covering and exposing the lip balm, said cover having a finger cradle, said finger cradle hingeably coupled to said cap, said finger cradle providing an easily discernible and tactile control for said cap despite impaired manual dexterity such as when mittens or gloves are worn, said cap conforming to said upper ends of said right side, said left side, and said rear panel of said housing to close the chapstick dispensing apparatus a lens, said lens adjacent said interior space for lip balm and making visible the lip balm, said lens framed by said upper and lower spanning supports and said right and left sides of said housing;

an ejector coupled to said housing and controllably ejecting the lip balm; whereby the chapstick dispenser is easily manipulated and used by hands encumbered as by gloves and mittens and prevents and relieves chapped lips in a convenient manner without risking loss of said cover.

9. The chapstick dispensing apparatus for conveniently dispensing lip balm as set forth in claim 8, further comprising:

said ejector having a threaded rod, said threaded rod threadedly engaging the lip balm to controllably extend and retract the lip balm, said ejector having a turnwheel, said turnwheel coupled to said threaded rod and controllably turning said threaded rod, said turnwheel being easily engaged by encumbered hands such as those wearing mittens or gloves so that control of lip balm disposition within said housing is selectably available by turning said turnwheel to controllably extend and retract the lip balm.

10. The chapstick dispensing apparatus for conveniently dispensing lip balm as set forth in claim 8, wherein said housing further comprises:

tactile protrusions, said tactile protrusions attached to an exterior of said housing and indicating in a tactile manner disposition and orientation of said housing, said tactile protrusion sufficiently pronounced to be manually detected through mittens or gloves.

11. The chapstick dispensing apparatus for conveniently dispensing lip balm as set forth in claim 10, wherein said tactile protrusions further comprises:

a series of outward projections projecting outwardly from said housing, said outward projections more pronounced toward a base of said housing and less pronounced toward a top of said housing, said series of outward projections generally conforming to a finger gripping said housing, said outward projections selected from the group consisting of squares, rectangles, circles, ovals, and triangles.

* * * * *

UNITED STATES PATENT AND TRADEMARK OFFICE

CERTIFICATE OF CORRECTION

PATENT NO. : 6,283,658 B1 
DATED : September 4, 2001
INVENTOR(S) : Estevez, Carlos Irwin and Thomason, Rodger D.

It is certified that error appears in the above-identified patent and that said Letters Patent is hereby corrected as shown below:

Title page,
Item [74], *Attorney, Agent or Firm*, should read -- CISLO & THOMAS LLP --

Signed and Sealed this

Twenty-first Day of June, 2005

JON W. DUDAS
*Director of the United States Patent and Trademark Office*